US006448211B1

(12) United States Patent
Peterson et al.

(10) Patent No.: US 6,448,211 B1
(45) Date of Patent: Sep. 10, 2002

(54) COMPOSITION AND ASSOCIATED METHOD FOR INHIBITING STAIN FORMATION ON A FERROUS METAL SURFACE

(75) Inventors: Joseph C. Peterson, Carmel; Darren R. Bowman, Noblesville; Tucker D. Maurer, Indianapolis, all of IN (US)

(73) Assignee: Crown Technology, Inc., Indianapolis, IN (US)

( * ) Notice: Subject to any disclaimer, the term of this patent is extended or adjusted under 35 U.S.C. 154(b) by 149 days.

(21) Appl. No.: 09/658,850

(22) Filed: Sep. 11, 2000

(51) Int. Cl.[7] ..... C11D 1/38; C11D 7/26; C11D 7/06

(52) U.S. Cl. ..... 510/245; 510/259; 510/272; 510/477; 510/488; 510/504

(58) Field of Search ..... 510/245, 259, 510/272, 477, 488, 504

(56) References Cited

U.S. PATENT DOCUMENTS 5,186,857 A * 2/1993 Ramirez et al. ..... 252/167
5,653,970 A * 8/1997 Vermeer ..... 424/70.24
5,656,280 A * 8/1997 Herb et al. ..... 424/401
5,916,379 A 6/1999 Varley et al. ..... 148/252
6,022,547 A * 2/2000 Herb et al. ..... 424/401
6,069,120 A * 5/2000 Asgharian et al. ..... 510/114
6,231,843 B1 * 5/2001 Hoelzel et al. ..... 424/70.19

OTHER PUBLICATIONS

Rhodia HPCII, An Innovative Product Range for Customized Solutions, Copyright Rhodia, Inc. 2000, Printed in USA, p. 44 (Sep. 2000).

* cited by examiner

*Primary Examiner*—Gregory Delcotto
(74) *Attorney, Agent, or Firm*—Leagre Chandler & Millard LLP

(57) ABSTRACT

A composition for adding to an aqueous rinse which is applied to a ferrous metal surface after treatment of the ferrous metal surface with an aqueous acid solution is disclosed. The composition includes a base. The base is present in the composition in an amount sufficient to adjust the pH of the aqueous rinse to a value greater than 7.0 after the composition is added to the aqueous rinse. The composition also includes a salt of gluconic acid. The composition further includes a polyquaternium compound. An associated method for inhibiting stain formation on a ferrous metal surface is also disclosed.

14 Claims, 1 Drawing Sheet

COMPOSITION AND ASSOCIATED METHOD FOR INHIBITING STAIN FORMATION ON A FERROUS METAL SURFACE

BACKGROUND OF THE INVENTION

The present invention generally relates to a composition and an associated method for inhibiting stain formation on a ferrous metal surface. The present invention particularly relates to a composition and an associated method for inhibiting stain formation on a ferrous metal surface after acid pickling of the ferrous metal surface.

The process utilized to manufacture steel results in an oxide layer or "scale" being formed on the surface of the steel. Typically, the scale is removed from the surface of the steel by a process commonly known in the industry as pickling. Pickling generally includes advancing the steel through a series of aqueous baths (e.g. four baths) containing hot (85° C.) hydrochloric acid and ferrous chloride. After the above described acidic treatment, the acid and salt (i.e. ferrous chloride) deposited on the steel must be removed. Removing the acid and salt typically includes advancing the steel through a number of rinsing baths where the surface of the steel is sprayed, flooded, or immersed in hard, softened, or demineralized water.

While the above described process effectively removes the scale, acid, and salt from the steel, it suffers from a number of drawbacks. In particular, removing the scale with the acidic treatment generates a "chemically reactive fresh surface" on the steel which can react with substances present in the rinse bath environment. For example, if the advancement of the steel through the rinsing baths is stopped so that the steel remains in the rinse bath environment for a relatively extended period of time (e.g. 1 to 5 minutes) chemicals such as oxygen, residual acid, and/or salts present in the rinse bath environment react with the surface of the steel. The reaction of these substances with the surface of the steel results in a stain and/or a rust spot being formed on the surface. Unfortunately, the advancement of the steel through the rinsing baths is periodically stopped for relatively extended periods of time due to power outages, mechanical breakdowns, or the time required to weld pieces of steel together prior to undergoing the pickling process. Therefore, the section of steel positioned within the rinse baths during these periodic stops will have a number of stains or rust spots formed thereon. Before the steel can be used to fabricate other products, such as cars, the stains and/or rust spots must be removed by repickling the steel or by cutting out the stained and/or rusted sections. Neither method is desirable since both increase the cost of manufacturing steel.

Therefore, in light of the above discussion, it is apparent that what is needed is a composition and an associated method which substantially inhibits or prevents the formation of stains and/or rust spots on a steel surface during the aforementioned rinsing process.

SUMMARY OF THE INVENTION

In accordance with one embodiment of the present invention, there is provided an effective passivating composition for adding to an aqueous rinse which is applied to a ferrous metal surface after treatment of the ferrous metal surface with an aqueous acid solution. The composition includes a salt of gluconic acid and a polyquaternium compound.

Pursuant to another embodiment of the present invention, there is provided an effective passivating composition for inhibiting stain formation on a ferrous metal surface. The composition includes a base. The base is present in the composition in an amount sufficient to adjust the pH of an aqueous rinse to a value greater than 7.0 after the composition is added to the aqueous rinse. The composition also includes a gluconate and Poly[oxy-1,2-ethanediyl (dimethyliminio)-1,3-propanediyliminocarbonylimino-1,3-propanedily (dimethyliminio)-1,2-ethanediyl dichloride]. Poly[oxy-1,2-ethanediyl(dimethyliminio)-1,3-propanediyliminocarbonylimino-1,3-propanediyl (dimethyliminio)-1,2-ethanediyl dichloride] is present in the composition in a sufficient amount such that after the composition is added to the aqueous rinse Poly[oxy-1,2-ethanediyl(dimethyliminio)-1,3-propanediyliminocarbonylimino-1,3-propanediyl (dimethyliminio)-1,2-ethanediyl dichloride] is about 0.003% to about 0.05% by weight per liter of the aqueous rinse.

Pursuant to yet another embodiment of the present invention there is provided a method of inhibiting stain formation on a ferrous metal surface. The method includes the step of contacting the ferrous metal surface with (i) a salt of gluconic acid and (ii) a polyquaternium compound.

It is therefore an object of the present invention to provide a new and useful composition and associated method for inhibiting stain and/or rust formation on a ferrous metal surface after treatment with an aqueous acid solution.

It is another object of the present invention to provide an improved composition and associated method for inhibiting stain and/or rust formation on a ferrous metal surface after treatment with an aqueous acid solution.

The above and other objects, features, and advantages of the present invention will become apparent from the following description and attached drawings.

DETAILED DESCRIPTION OF THE PREFERRED EMBODIMENT

Figure 1:
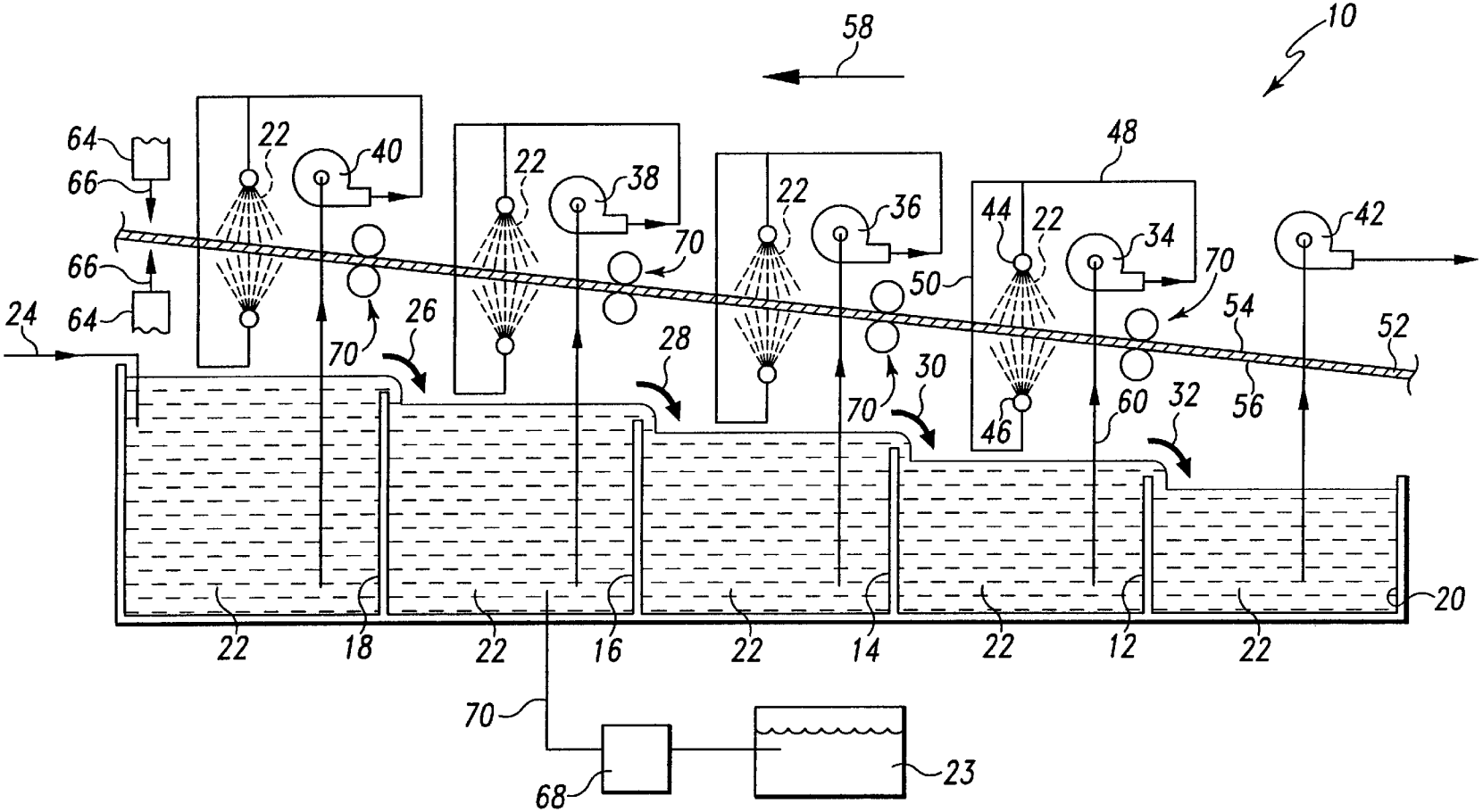
FIG. 1 is a schematic representation of an arrangement used to rinse acid and salt off of a section of steel after treating the section of steel with an aqueous acid solution.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring to FIG. 1, there is shown an exemplary schematic representation of an arrangement 10 used to rinse acid and salt off of a steel section 52 after treating steel section 52 with an aqueous acid solution as previously described. It should be appreciated that arrangement 10 is only one example of a rinsing mechanism and the present invention can be utilized in virtually any arrangement used to rinse acid and salt off of a steel section after treatment with an aqueous acid solution.

Arrangement 10 includes four linearly positioned rinse baths 12, 14, 16, and 18. An aqueous rinse 22 is pumped into rinse bath 18 in the direction indicated by arrow 24. After filling rinse bath 18, aqueous rinse 22 overflows into rinse bath 16 in the direction indicated by arrow 26. After filling rinse bath 16, aqueous rinse 22 overflows into rinse bath 14 in the direction indicated by arrow 28. The overflow of aqueous rinse 22 from one rinse bath to an adjacent rinse bath continues in the directions indicated by arrows 26, 28, and 30 until aqueous rinse 22 is constantly flowing through all of the rinse baths 18, 16, 14, and 12 in a cascading manner. After filling rinse bath 12, aqueous rinse 22 overflows into a tank 20 in the direction indicated by arrow 32. Tank 20 is in fluid communication with a pump 42 which advances aqueous rinse 22 from tank 20 and to a water treatment facility (not shown).

Each rinse bath 12, 14, 16, and 18 is in fluid communication with a pump. In particular, rinse baths 12, 14, 16, and 18 are in fluid communication with pumps 34, 36, 38, and 40, respectively. Pump 34 is in fluid communication with a pair of spray nozzles 44 and 46 via lines 48 and 50, respectively. During the operation of arrangement 10 pump 34 withdraws aqueous rinse 22 from rinse bath 12 via line 60 and advances the same to spray nozzles 44 and 46 via lines 48 and 50. Each of pumps 36, 38, and 40 operate in a substantially identical manner as described for pump 34 and therefore will not be described in detail herein.

As previously described, steel section 52 is treated with an aqueous acid solution so as to remove the scale therefrom. After the scale has been removed, steel section 52 is advanced through arrangement 10 in the direction indicated by arrow 58 such that steel section 52 is interposed between each pair of spray nozzles (e.g. spray nozzles 44 and 46). Therefore, it should be understood that as steel section 52 is advanced through arrangement 10 each pair of spray nozzles sprays the aqueous rinse 22 contained within the associated rinse bath onto ferrous metal surface 54 and ferrous metal surface 56 of steel section 52. For example, spray nozzles 44 and 46 spray the aqueous rinse 22 contained within rise bath 12 onto ferrous metal surfaces 54 and 56 of steel section 52. After contacting ferrous metal surfaces 54 and 56 a substantial portion of the aqueous rinse 22 sprayed on these surfaces is directed back into rinse bath 12 as a result of wringer roll assembly 70. Each pair of spray nozzles operates to spray aqueous rinse 22 onto steel section 52 in a substantially identical manner as described for spray nozzles 44 and 46.

Arrangement 10 also includes a blowing mechanism 64 associated with rinse bath 18. Blowing mechanism 64 mechanically removes aqueous rinse 22 deposited onto steel section 52 by directing a stream of hot or cold air onto ferrous metal surfaces 54 and 56 of steel section 52 in the directions indicated by arrows 66. Furthermore, the aqueous rinse 22 contained within rinse bath 18 can be heated (e.g. to about 140° F.) to enhance the drying of steel section 52.

It should be understood that one aspect of the present invention includes adding an effective passivating composition of the present invention to aqueous rinse 22. What is meant herein by an effective passivating composition is a composition which substantially inhibits or prevents the previously described staining or rusting of steel section 52. In particular, the effective passivating composition (hereinafter referred to as a composition) of the present invention substantially prevents oxygen, halide (particularly chloride), and acid staining during the above described rinsing process. A composition of the present invention includes a base, a salt of gluconic acid, and a polyquaternium compound. It should be understood that the word "composition" as used herein includes a premixed solution, a suspension, or an emulsion of the base, the salt of gluconic acid, and the polyquaternium compound as well as arrangements that keep these components separate until their addition to the aqueous rinse. Examples of gluconic acid salts which can be used in the present invention include, but are not limited to, the ammonium salt, the magnesium salt, the sodium salt, the calcium salt, and the potassium salt. Examples of bases which can be used in the present invention include, but are not limited to, the alkali metal hydroxides, such as sodium hydroxide and potassium hydroxide.

What is meant herein by a polyquaternium compound is a water soluble or water miscible cationic polymer having a number of quaternized n itrogen atoms contained therein. Examples of synthetic polyquaternium compounds which can be utilized in the present invention include, but are not limited to, polyquaternium-1, polyquaternium-2, polyquaternium-4, polyquaternium-5, polyquaternium-6, polyquaternium-7, polyquaternium-8, polyquaternium-9, polyquaternium-10, polyquaternium-11, polyquaternium-12, polyquaternium-13, polyquaternium-14, polyquaternium-15, polyquaternium-16, polyquaternium-17, polyquaternium-18, polyquaternium-19, polyquaternium-20, polyquaternium-22, polyquaternium-24, polyquaternium-27, polyquaternium-28, polyquaternium-29, polyquaternium-30, and mixtures thereof, wherein the compound designation is the name adopted for the compound by the Cosmetic, Toiletry and Fragrance Association, and found in the CTFA International Cosmetic Ingredient Dictionary, J. Nikitakis, ed., Cosmetic, Toiletry and Fragrance Association, Inc., Washington, D.C. (1991) and/or the CTFA Cosmetic Ingredient Handbook, John A. Wenninger and G. N. McEwen Jr., ed, Cosmetic, Toiletry and Fragrance Association, Inc., Washington, D.C. (1992). Additional examples of polyquaternium compounds which can be utilized in the present invention include polyquaternium-31, polyquaternium-32, polyquaternium-33, polyquaternium-34, polyquaternium-35, polyquaternium-36, polyquaternium-37, polyquaternium-39, polyquaternium-42, polyquaternium-43, polyquaternium-44, polyquaternium-45, polyquaternium-46, polyquaternium-47, polyquaternium-48, polyquaternium-49, polyquaternium-50, and polyquaternium-51.

The following further describes the aforementioned polyquaternium compounds which can be used in the present invention. Polyquaternium-1 has the formula:

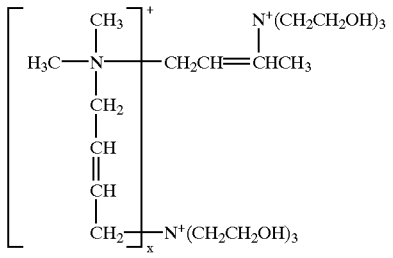

Polyquaternium-1 has the CAS Registry Number 75345-27-6 and the chemical name Poly[(dimethyliminio)-2-butene-1,4-diyl chloride], alpha.-[4-[tris(2-hydroxyethyl) ammonio]-2-butenyl]-.omega.-[tris(2-hydroxyethyl) ammonio]-, dichloride (9Cl). Polyquaternium-2 has the formula:

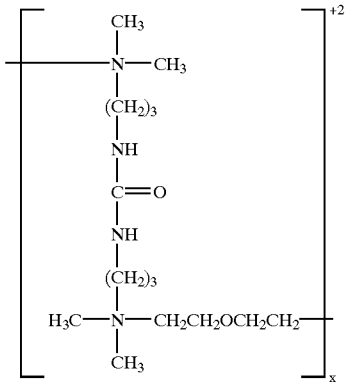

Polyquaternium-2 has the CAS Registry Number 63451-27-4 and the chemical name Poly[oxy-1,2-ethanediyl (dimethyliminio)-1,3-propanediyliminocarbonylimino-1,3-propanediyl (dimethyliminio)-1,2-ethanediyl dichloride] (9Cl). Polyquaternium-4 has the CAS Registry Number 92183-41-0 and the chemical name Cellulose, 2-hydroxyethyl ether, polymer with N, N-dimethyl-N-2-propenyl-2-propen-1-aminium chloride (9Cl). Polyquaternium-5 has the CAS Registry Number 26006-22-4 and the chemical name Ethanaminium, N,N,N-trimethyl-2-[(2-methyl-1-oxo-2-propenyl)oxy]-, methyl sulfate, polymer with 2-propenamide (9Cl). Polyquaternium-6 has the CAS Registry Number 26062-79-3 and the chemical name 2-Propen-1-aminium, N,N-dimethyl-N-2-propenyl-, chloride, homopolymer (9Cl). Polyquaternium-7 has the CAS Registry Number 26590-05-6 and the chemical name 2-Propen-1-aminium, N,N-dimethyl-N-2-propenyl-, chloride, polymer with 2-propenamide (9Cl). Polyquaternium-8 has the CAS Registry Number 130291-58-6 and the chemical name 2-Propenoic acid, 2-methyl-, 2-(dimethylamino)ethyl ester, homopolymer, compd. with bromomethane (9Cl). Polyquaternium-9 has the CAS Registry Number 130291-58-6 and the chemical name 2-Propenoic acid, 2-methyl-, 2-(dimethylamino)ethyl ester, homopolymer, compd. with bromomethane (9Cl). Polyquaternium-10 has the CAS Registry Number 81859-24-7 and the chemical name Cellulose, 2-hydroxyethyl 2-[2-hydroxy-3-(trimethylammonio) propoxy]ethyl 2-hydroxy-3-(trimethylammonio)propyl ether, chloride (9Cl). Polyquaternium-11 has the CAS Registry Number 53633-54-8 and the chemical name 2-Propenoic acid, 2-methyl-, 2-(dimethylamino)ethyl ester, polymer with 1-ethenyl-2-pyrrolidinone, compd. with diethyl sulfate (9Cl). Polyquaternium-12 has the CAS Registry Number 68877-50-9 and the chemical name 2-Propenoic acid, 2-methyl-, [(1R,4aR,4bR,10aR)-1,2,3,4,4a,4b,5,6,10,10a-decahydro-1,4a-dimethyl-7-(1-methylethyl)-1-phenanthrenyl]methyl ester, polymer with 2-(diethylamino)ethyl 2-methyl-2-propenoate and ethyl 2-methyl-2-propenoate, compd. with dimethyl sulfate (9Cl). Polyquaternium-13 has the CAS Registry Number 68877-47-4 and the chemical name 2-Propenoic acid, 2-methyl-, 2-(diethylamino)ethyl ester, polymer with ethyl 2-methyl-2-propenoate and (9Z)-9-octadecenyl 2-methyl-2-propenoate, compd. with dimethyl sulfate (9Cl). Polyquaternium-14 has the formula:

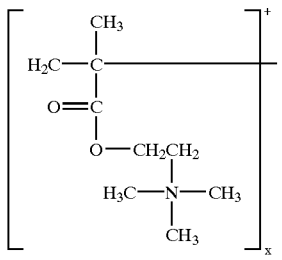

Polyquaternium-14 has the CAS Registry Number 27103-90-8 and the chemical name Ethanaminium, N,N,N-trimethyl-2-[(2-methyl-1-oxo-2-propenyl)oxy]-, methyl sulfate, homopolymer (9Cl). Polyquaternium-15 has the CAS Registry Number 35429-19-7 and the chemical name Ethanaminium, N,N,N-trimethyl-2-[(2-methyl-1-oxo-2-propenyl)oxy]-, chloride, polymer with 2-propenamide (9Cl). Polyquaternium-16 has the CAS Registry Number 95144-24-4 and the chemical name 1H-Imidazolium, 1-ethenyl-3-methyl-, chloride, polymer with 1-ethenyl-2-pyrrolidinone (9Cl). Polyquaternium-17 has the formula:

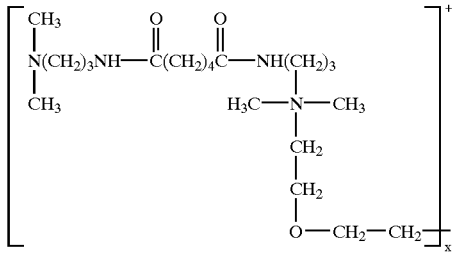

Polyquaternium-17 has the CAS Registry Number 148506-50-7 and the chemical name Poly[oxy-1,2-ethanediyl (dimethyliminio)-1,3-propanediylimino(1,6-dioxo-1,6-hexanediyl)imino-1,3-propanediyl(dimethliminio)-1,2-ethanediyl dichloride] (9Cl). Polyquaternium-18 has the formula:

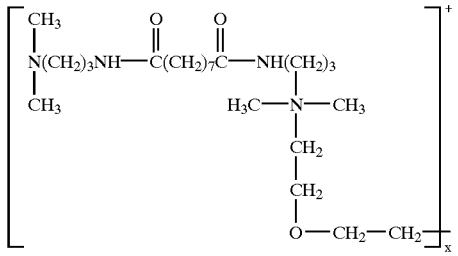

Polyquaternium-18 has the CAS Registry Number 113784-58-0 and the chemical name Poly[oxy-1,2-ethanediyl (dimethyliminio)-1,3-propanediylimino(1,9-dioxo-1,9-nonanediyl)imino-1,3-propanediyl(dimethyliminio)-1,2-ethanediyl dichloride] (9Cl). Polyquaternium-19 has the CAS Registry Number 110736-85-1. Polyquaternium-20 has the CAS Registry Number 110736-86-2. Polyquaternium-22 has the formula:

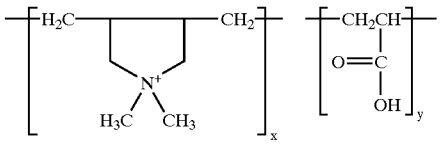

Polyquaternium-22 has the CAS Registry Number 53694-17-0 and the chemical name 2-Propen-1-aminium, N,N-dimethyl-N-2-propenyl-, chloride, polymer with 2-propenoic acid (9Cl). Polyquaternium-24 has the CAS Registry Number 98616-25-2 and the chemical name Cellulose, ether with .alpha.-[3-(dodecyldimethylammonio)-2-hydroxypropyl]-.omega.-hydroxypoly(oxy-1,2-ethanediyl) chloride (9Cl). Polyquaternium-27 has the CAS Registry Number 132977-85-6 and the chemical name Hexanediamide, N,N'-bis[3-(dimethylamino)propyl]-, polymer with N,N'-bis[3-(dimethylamino)propyl]urea and 1,1'-oxybis[2-chloroethane], block (9Cl). Polyquaternium-28 has the formula:

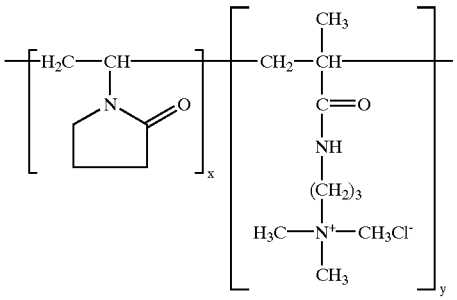

Polyquaternium-28 has the CAS Registry Number 131954-48-8 and the chemical name 1-Propanaminium, N,N,N-trimethyl-3-[(2-methyl-1-oxo-2-propenyl)amino]-, chloride, polymer with 1-ethenyl-2-pyrrolidinone (9Cl). Polyquaternium-29 has the CAS Registry Number 148880-30-2. Polyquaternium-28 has the formula:

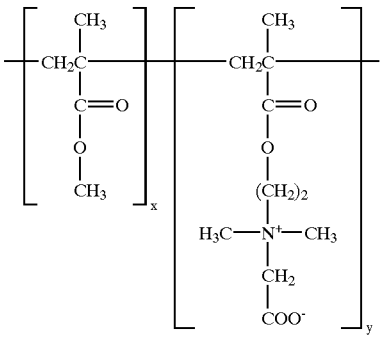

Polyquaternium-30 has the CAS Registry Number 147398-77-4 and the chemical name Ethanaminium, N-(carboxymethyl)-N,N-dimethyl-2-[(2-methyl-1-oxo-2-propenyl)oxy]-, inner salt, polymer with methyl 2-methyl-2-propenoate (9Cl). Polyquaternium-31 has the CAS Registry Number 189767-67-7. Polyquaternium-33 has the CAS Registry Number 69418-26-4 and the chemical name Chemical Name Ethanaminium, N,N,N-trimethyl-2-[(1-oxo-2-propenyl)oxy]-, chloride, polymer with 2-propenamide (9Cl). Polyquaternium-34 has the CAS Registry Number 189767-68-8. Polyquaternium-35 has the CAS Registry Number 189767-69-9. Polyquaternium-36 has the CAS Registry Number 60494-40-8 and the chemical name 2-Propenoic acid, 2-methyl-, 2-(dimethylamino)ethyl ester, polymer with methyl 2-methyl-2-propenoate, compd. with dimethyl sulfate (9Cl). Polyquaternium-37 has the CAS Registry Number 26161-33-1 and the chemical name Ethanaminium, N,N,N-trimethyl-2-[(2-methyl-1-oxo-2-propenyl)oxy]-, chloride, homopolymer (9Cl). Polyquaternium-39 has the CAS Registry Number 25136-75-8 and the chemical name 2-Propen-1-aminium, N,N-dimethyl-N-2-propenyl-, chloride, polymer with 2-propenamide and 2-propenoic acid (9Cl). Polyquaternium-42 has the CAS Registry Number 31512-74-0 and the chemical name Poly[oxy-1,2-ethanediyl (dimethyliminio)-1,2-ethanediyl(dimethyliminio)-1,2-ethanediyl dichloride] (9Cl). Polyquaternium-44 has the CAS Registry Number 150599-70-5 and the chemical name 1H-Imidazolium, 1-ethenyl-3-methyl-, methyl sulfate, polymer with 1-ethenyl-2-pyrrolidinone (9Cl). Polyquaternium-46 has the CAS Registry Number 174761-16-1 and the chemical name 1H-Imidazolium, 1-ethenyl-3-methyl-, methyl sulfate, polymer with 1-ethenylhexahydro-2H-azepin-2-one and 1-ethenyl-2-pyrrolidinone (9Cl). Polyquaternium-47 has the CAS Registry Number 197969-51-0 and the chemical name 1-Propanaminium, N,N,N-trimethyl-3-[(2-methyl-1-oxo-2-propenyl)amino]-, chloride, polymer with methyl 2-propenoate and 2-propenoic acid (9Cl). It should be understood that the abstract associated with each of the aforementioned CAS Registry Numbers is incorporated herein by reference.

Polyquaternium-2 is commercially available from Ethox Chemicals, Inc. located in Greenville, S.C. Polyquaternium-2 is also commercially available from Rhodia, Inc. located in Cranbury, N.J. as are polyquaternium-6, polyquaternium-7, and polyquaternium-27. Polyquaternium-4 is commercially available from National Starch & Chemical Company located in Bridgewater, N.J. as is polyquaternium-10. Polyquaternium-5 is commercially available from Calgon Corporation located in Pittsburgh, Pa. as are polyquaternium-6, polyquaternium-7, polyquaternium-22, polyquaternium-39, and polyquaternium-47. Polyquaternium-6 is also commercially available from A & E Connock (Perfumery & Cosmetics) Ltd. located in Hampshire, United Kingdom as are polyquaternium-7 and polyquaternium-10. Polyquaternium-6 and polyquaternium-7 are also commercially available from Tri-K Industries in Northvale, N.J. as is polyquaternium-11. Polyquaternium-7, polyquaternium-22, and polyquaternium-39 are commercially available from Calgon Europe located in Hamburg, Germany. Polyquaternium-7 is also commercially available from Allied Colloids, Ltd. located in West Yorkshire, United Kingdom as are polyquaternium-32 and polyquaternium-37. Polyquaternium-10 and polyquaternium-24 are commercially available from Amerchol Corporation located in Edison, N.J. Polyquaternium-11 is also commercially available from BASF Corporation located in Washington, N.J. as are polyquaternium-16, polyquaternium-44, and polyquaternium-46. Polyquaternium-11 and polyquaternium-28 are commercially available from International Specialty Products located in Wayne, N.J. Polyquaternium-15, polyquaternium-35, polyquaternium-36, and polyquaternium-45 are commercially available from Rohm GmbH Chemische Fabrik located in Darmstadt, Germany. Polyquaternium-30 and polyquaternium-34 are commercially available from Chimex located in Gonesse, France. Polyquaternium-31 is commercially available from Lipo Chemicals, Inc. located in Paterson, N.J. and from Essential Ingredients, Inc. located in Buford, Ga. Polyquaternium-35 and polyquaternium-36 are commercially available from Rohm Tech, Inc. located in Maiden, Mass. Polyquaternium-42 is commercially available from Buckman Laboratories International, Inc. located in Memphis, Tenn. Polyquaternium-43 is commercially available from Clariant (France) S.A. located in Cedex, France. Polyquaternium-48, polyquaternium-49, and polyquaternium-50 are commercially available from Goo Chemical Company, Ltd. located in Kyoto, Japan. Polyquaternium-51 is commercially available from NOF Corporation located in Tokyo, Japan.

As previously discussed, an effective passivating composition of the present invention is added to aqueous rinse 22. In particular, an aqueous solution 23 containing the effective passivating composition (i.e. an amount of (i) a base, such as sodium hydroxide, (ii) a salt of gluconic acid, such as sodium gluconate, and (iii) a polyquaternium compound, such as polyquaternium-2) is prepared. This aqueous solution 23 is added to each rinse bath 12, 14, and 16 so that each rinse bath is about 0.25% (v/v) of the aqueous solution. As will be discussed in greater detail below, preferably no aqueous solution 23 is added to rinse bath 18. However, it should be understood that, if required, aqueous solution 23 can be added to rise bath 18 in a manner similar to that described below for rinse bath 16. In particular, one way of adding aqueous solution 23 in to rinse baths 12, 14, and 16 is to meter (pump) aqueous solution 23 into rinse bath 16 with a pump 68 via line 70 so that the concentration of aqueous solution 23 in rinse bath 16 is continuously maintained at about 0.25%. Maintaining the concentration of aqueous solution 23 in rinse bath 16 at about 0.25% results in the concentration of aqueous solution 23 in rinse baths 14 and 12 also being about 0.25% since aqueous rinse 22 cascades from rinse bath 16 into rinse baths 14 and 12. The rate at which aqueous solution 23 is metered into bath 16 depends upon the rate at which aqueous rinse 22 is pumped into rinse bath 18 in the direction indicated by arrow 24. It should be understood that the aforementioned aqueous solution 23 contains a sufficient amount of base, salt of gluconic acid, and polyquaternium compound such that when the aqueous solution 23 is added to the aqueous rinse 22 contained in rinse baths 12, 14, and 16 in the above described manner each rinse bath 12, 14, and 16 contains these components (i.e. a base, a salt of gluconic acid, and a polyquaternium compound) at a concentration sufficient to produce the desired effect, i.e. substantially inhibit or prevent the previously described staining or rusting of steel section 52. On the other hand, the concentration of these components in each rinse bath should not be so large so as to cause undesirable side effects, such as the components crystallizing, or otherwise precipitating, during the rinsing procedure. For example, the aforementioned aqueous solution 23 can contain a sufficient amount of base, salt of gluconic acid, and polyquaternium compound such that when the aqueous solution 23 is added to the aqueous rinse 22 contained in rinse baths 12, 14, and 16 in the above described manner each rinse bath 12,14, and 16 continuously contains (i) the base at about 0.002% to about 0.2% by weight per liter of aqueous rinse 22, (ii) the salt of gluconic acid at about 0.003% to about 0.3% by weight per liter of aqueous rinse 22, and (iii) the polyquaternium compound at about 0.0005% to about 0.05% by weight per liter of aqueous rinse 22. However, it is preferable that each rinse bath 12, 14, and 16 continuously contains (i) the base at about 0.015% to about 0.2% by weight per liter of aqueous rinse 22, (ii) the salt of gluconic acid at about 0.02% to about 0.3% by weight per liter of aqueous rinse 22, and (iii) the polyquaternium compound at about 0.003% to about 0.05% by weight per liter of aqueous rinse 22. It is even more preferable that each rinse bath 12, 14, and 16 continuously contains (i) the base at about 0.02% by weight per liter of aqueous rinse 22, (ii) the salt of gluconic acid at about 0.03% by weight per liter of aqueous rinse 22, and (iii) the polyquaternium compound at about 0.005% by weight per liter of aqueous rinse 22.

Furthermore, the aqueous solution 23 containing the base, the gluconate and the polyquaternium compound can also have a wetting agent contained therein. What is meant herein by "wetting agent" is a substance that reduces the surface tension of a liquid (e.g. the aqueous rinse 22) so that the liquid spreads over a surface (e.g. ferrous metal surfaces 54 and 56) rather than beading up thereon. One wetting agent which can be used in the present invention is Mirataine ASC which is commercially available from Rhodia, Inc. located in Cranbury, N.J. The wetting agent is added to the aqueous solution 23 so that the aqueous solution 23 contains from about 1% to about 10% w/w of the wetting agent.

Therefore, based upon the above discussion, it should be appreciated that as steel section 52 is advanced through arrangement 10, the base, the salt of gluconic acid, the polyquaternium compound, and the wetting agent of the composition of the present invention are all sprayed onto ferrous metal surfaces 54 and 56 of steel section 52.

It should be appreciated that the pH of the aqueous rinse 22 contained within the first few rinse baths exposed to steel section 52 after advancing steel section 52 through the previously described aqueous acid treatment will be relatively low due to the large amount of acid initially washed off of steel section 52 as it passes through arrangement 10. For example, the pH of the aqueous rinse 22 contained within rinse baths 12 and 14 should be about 2 or below. However, it is preferable that the pH of the aqueous rinse 22 contained within rinse baths 12 and 14 be maintained at a slightly lower pH, for example about 1.5. Typically, the acid carry over from the acid treatment of steel section 52 will keep the pH of rinse baths 12 and 14 at about 1.5. However, additional acid can be added to these rinse bathes to maintain the pH at the desired level. On the other hand, the pH of the aqueous rinse 22 contained within the rinse baths positioned after the aforementioned first few rinse baths should be relatively alkaline due to the base contained within the composition of the present invention. For example, the pH of the aqueous rinse 22 contained within rinse bath 16 should be kept above 7. Preferably, the pH of the aqueous rinse 22 contained within rinse bath 16 should be kept between about 10 and about 11. More preferably, the pH of the aqueous rinse 22 contained within rinse bath 16 should be kept at about 10.5. Note that there could be more than one rinse bath which should be kept alkaline as described above depending upon the particular arrangement utilized to rinse steel section 52. For example, if aqueous solution 23 is also added to rinse bath 18, the pH of the aqueous rinse 22 contained within rinse bath 18 should be kept in the same levels as described above for rinse bath 16.

It should be appreciated that treating steel section 52 with the composition of the present in the above described manner protects ferrous metal surfaces 54 and 56 against staining or rust so well that the last rinse bath (e.g. rinse bath 18) steel section 52 is subjected to before exiting arrangement 10 does not have to contain the composition of the present invention. In other words, the last rinse bath only contains water which is substantially free of substances such as salts, acids, bases, or polyquaternium compounds. Having the last rinse bath contain only water is an advantage of the present invention since it ensures that steel section 52 will be free of any contaminating residues as steel section 52 is dried and exits arrangement 10. For example, having the last rinse bath contain only water ensures that ferrous metal surfaces 54 and 56 of steel section 52 are substantially free of any dried salt residues which can eventually cause the corrosion of steel section 52. However, as previously mentioned, if required the last bath can also have the composition of the present invention contained therein.

In the following examples the composition of the present invention included sodium hydroxide, sodium gluconate, and polyquaternium-2. The aqueous solution containing these compounds was prepared such that when the same was added to a rinse bath in an amount such that the rinse bath was 0.25% (v/v) of the aqueous solution, the rinse bath contained (i) about 0.02% sodium hydroxide by weight per liter of aqueous rinse, (ii) about 0.03% sodium gluconate by weight per liter of aqueous rinse, and (iii) about 0.005% polyquaternium-2 by weight per liter of aqueous rinse. Hereinafter this aqueous solution will be referred to as "solution A".

EXAMPLE I

A spray/flood rinse system similar to arrangement 10 having 5 rinse baths (hereinafter referred to as baths) was utilized in this example. The system feeds fresh water into baths 4 and 5 at about 10 gpm. Note that baths 4 and 5 are analogous to rinse baths 16 and 18 of arrangement 10. The capacity of each bath of the system was about 2200 gallons. The water in bath 5 was heated to 170° F. and higher, while baths 1–4 were only heated by the cascading of the water out of bath 5. A metering pump was purged for several minutes with solution A. This metering pump was set to 60% of its 60 gpd maximum (i.e. the 0.25% v/v addition rate). The fresh water supply to bath 4 was shut off and the addition to bath 5 was confirmed to be 10 gpm. The pH levels in each bath 5, 4, 3, 2, and 1 before adding solution A was 8.5, 8.4, 7.8, 2.45, and 1.4, respectively. Measured chloride levels were 20 ppm in bath 5, and 25 ppm in bath 4.

The advancement of the steel through the baths was stopped for one minute (i.e. a one minute spray stop) (no flood) without adding solution A to the aqueous rinse thereby generating a baseline stain. Significant brown and blush stains were visually observed on the steel section located in all baths. Thereafter, solution A was added to baths 1 and 3–5 such that solution A was about 0.25% v/v in the aforementioned baths. Baths 1 and 3–5 were allowed to equilibrate for a few minutes. The pH level in each bath after the addition of solution A was 10.0, 10.6, 10.7, and 1.4 for baths 5, 4, 3, and 1, respectively. The advancement of the steel through the baths was stopped for one minute. The one minute stop in the presence of solution A generated absolutely no discernible marks or stains on the steel section positioned in baths 3–5. The section of steel positioned in bath 1 demonstrated a slight dulling due to the acid content, but almost no distinguishable impact marks were visible. The section of steel positioned in bath 2 had significant black staining due to a pump malfunction which resulted in no aqueous rinse being sprayed onto the steel section located therein.

Another test was performed under substantially identical conditions to those described above with the exception that the advancement of the steel through the system was stopped for two minutes. The two minute stop test produced results which were substantially identical to the one minute test, i.e. the steel section located in baths 3–5 were completely without stain, while the steel section located in bath 1 only showed slight gray discoloration.

A final three minute spray stop was performed. The results were identical to the shorter stops in baths 3–5, while moderate impact marks (i.e. stains) were now visible on the section of steel positioned in bath 1 due to dilution by bath 2 which contained no solution A. Dilution calculations indicate that there was approximately 60% of the recommended amount of sodium hydroxide, sodium gluconate, and polyquaternium-2 in bath 1 during the three minute stop. The measured pH levels in baths 5, 4, 3, and 1 were 10.4, 10.7, 10.6, and 1.4, respectively. The final measured chloride levels were 26 ppm in bath 5, and 28 ppm in bath 4.

The ability of the present invention to substantially prevent stains and/or rust in a flood rinse system was also tested under substantially identical conditions as those described above with the exception that the steel section was flood rinsed rather than spray rinsed. The pH levels in baths 5, 4, 3, and 1 were 10.3, 10.7,10.6, and 1.4, respectively. A three minute flood stop generated similar results to the spray, i.e. no marks or stains were evident on the sections of steel positioned in baths 3–5, while the section of steel positioned in bath 1 had a slight gray discoloration.

Note that after adding solution A, a brown edge stain was observed during normal processing of the steel section. At this point the temperature of bath 5 was lowered to 150° F. and the hot air was shut off to the blowers. Although the rinse bath was not allowed to cool completely, the elimination of the hot blow off improved the edge stain. It appears that the root cause of the edge stain was the result of the components (i.e. sodium hydroxide, sodium gluconate, and polyquaternium-2) contained in solution A, or other chemical substances, being dried onto the steel section so as to cause a residue thereon. This occurs when the aqueous rinse is evaporated off of the steel section rather than being physically removed by the blow off (i.e. insufficient blow off). This evaporation can leave dried salts or other substances on the surface of the steel which can cause discoloration. Therefore, as previously mentioned, the temperature of bath 5 is preferably lowered to about 140° F. as opposed to 170° F. thereby preventing a condition known as flash drying in which the aqueous rinse is evaporated before the blow off can occur. In addition, utilizing a cool air blow off rather than a hot air blow off enhances the mechanical removal of the aqueous rinse from the steel surface as opposed to the aqueous rinse being evaporated off of the steel surface. Moreover, the speed at which the steel is advanced through the baths can be reduced so as to enhance the efficiency of the cool air blow off.

The use of dry lube requires high temperatures to be effective. Under these circumstances it is possible to temporarily raise the aqueous rinse temperature until the coils requiring the dry lube have been processed. At this point the rate of fresh water addition to the baths is increased to help cool the bath down to normal temperatures which enhance the mechanical blow off of the aqueous rinse.

EXAMPLE II

A rinse system similar to the flood system utilized in Example I was employed. The pump associated with bath 4 was inoperable, so no spray was available in that bath. Without adequate mixing, the cascade of solution A back from bath 4 would be questionable, so baths 1, 2, and 3 were dosed with 0.25% solution A v/v and solution A was metered into bath 3 directly. Fresh water was sprayed in bath 5 throughout the trial. Fresh water was added to bath 5 at a rate of 10 gpm, so the metering pump associated with rinse bath 3 was set to deliver solution A at approximately 1.5 gph. Due to dry lube requirements, the temperature of bath 5 was 181° F. Measured pH values were 8.7, 4.7, 10.8, 3.5, and 1.8 for baths 5, 4, 3, 2, and 1, respectively. The high pH values in baths 1 and 2 were attributed to minimal acid carryover due to slow process speeds (approximately 110 fpm) as required for the dry lube. The pH of bath 3 fell to 10.45 during the following 1.5 hours.

Periodic two minute flood stops were conducted during the aforementioned 1.5 hour time period. Each periodic two minute flood stop gave nearly identical results. In particular, the steel section located in baths 4 and 5 showed very light blush discoloration, while the section of steel located in bath 3 was stain free. Note that even though no solution A was present in baths 4 and 5 the section of steel located therein still only showed a very light blush discoloration thereby demonstrating that the surface of the steel continued to be passivated as a result of its exposure to solution A in baths 1, 2, and 3. The steel section located in bath 2 showed extremely light impact marks that were brighter than the surrounding steel. Bath 1 showed a general light gray discoloration. Flood stops of shorter duration produced no distinguishable staining or discoloration.

Another test was performed under similar conditions with the exception that the solution A feed rate into the rinse system was lowered to simulate lean conditions. The measured pH values were 9.0, 4.7, 9.8, 3.4, and 1.7 in baths 5, 4, 3, 2, and 1, respectively. A two minute flood stop was performed. Once again baths 4 and 5 showed very light blush discoloration, and bath 3 was largely without impact marks. The portion of the steel located in bath 3 showed some wringer roll marks. Apparently this was due to a combination of the lean conditions currently running, lower pH, and the presence of the dry lube. The section of steel positioned in bath 2 showed moderate dark impact "smears" while the section of steel positioned in bath 1 was slightly discolored gray with faint impact marks. Bath 2 would produce considerably less staining at a lower pH, as 3.4 is above the preferred pH value (i.e. 1.5).

A further test was run after switching the pickle line from dry lube. The temperature in bath 5 was set to about 140° F. and the heat to the blow off mechanism was turned off. After allowing each bath to thermally equilibrate the temperature in baths 1, 2 and 3 was 130° F. Bath 4 had a temperature greater than 100° F. and bath 5 had a temperature of 140° F. The measured pH values in baths 3, 2, and 1 respectively were 10.3, 3.3, and 1.5. A 4.5 minute flood stop was performed. The steel section located in bath 3 showed no staining other than faint wringer roll marks, the steel section located in bath 2 showed slight impact smudging, and the steel section located in bath 1 showed the typical faint gray discoloration. Note that the steel was being advanced through the rinsing system at about 250 feet/min. In addition, no dried residue (e.g. dried salt residue) was detected on the steel coming out of the system thus indicating that no solution A was present in the last bath.

The pH values in the baths were measured again after about 9 hours with the following results bath 5=8.8, bath 4=4.9, bath 3=9.1, bath 2=2.8, and bath 1=1.4. One reason for the relatively low pH values was due to the processing of narrow 19" coiled steel which has significantly more acid carry out than normal coils.

Based upon the results of the above described examples, as previously discussed, it is preferable that solution A be utilized at 0.25% v/v and the baths are kept within the aforementioned pH conditions. The rate of addition of solution A should be 0.25% v/v of the volume of fresh water added (i.e. 1.5 gallons/hour solution A at 10 gallons/minute fresh water). As indicated above, baths 3, 4 and 5 all produced the best results (i.e. the best stain and rust inhibition) when the pH was about 10.5 and higher. Under these conditions the steel section emerging from these baths was bright, had no marks, and could not be distinguished from one another. Conversely, the performance in baths 1 and 2 is the best when the pH therein is kept relatively low, i.e. below about 2. One way to maintain the pH low in baths 1 and 2 is to open the wringer rolls between baths 1 and 2 so as to allow a little more acid carryover. In addition, a 0.25% v/v solution A concentration will minimize the impact marks in baths 1 and 2 and result in only a little general gray discoloration therein (baths 3, 4, and 5 will always be a little brighter than 1 and 2 due to the acid content). However, it should be understood that the pH in bath 3 should be monitored closely to ensure that it does not drop below about 10. Thus, it should be appreciated that an advantage of the present invention is that the gluconate and the polyquaternium compound cooperate to provide substantial stain and/or rust protection in both alkaline and acidic environments. In particular, the gluconate protects the steel from stains in an alkaline environment while the polyquaternium protects the steel from stains in an acidic environment. This is in contrast to other anti-stain and/or anti-rust compositions which provide protection only under acidic or alkaline conditions. For example, some anti-rust and/or anti-stain compositions provide stain and/or rust protection in an acidic environment while providing very little protection or actually causing a stain in an alkaline environment. Furthermore, the exposure of the steel to both an acidic environment and an alkaline environment in the presence of a gluconate and a polyquaternium compound enhances the stain and/or rust protecting properties of these compounds and thus helps to ensure that the steel has an acceptable finish upon completion of the rinsing procedure.

EXAMPLE III

A spray/flood rinse system similar to arrangement 10 having 5 baths was utilized in this example. The pH of baths 5 through 1 was 8.0, 8.1, 8.3, 7.7 and 1.3, respectively. The chloride in bath 5 was 38 ppm. The Fe in bath 5 was 2 ppm. The conductivity in baths 5 and 4 was 820 and 966, respectively. The advancement of the steel through the baths was stopped for five minutes without adding solution A to the baths thereby generating a baseline stain. The five minute stop resulted in a very dark gray stained sheet of steel with no spray pattern visible.

Thereafter, solution A was added to the baths. In particular, about 4 gallons was added to bath 5 and about 2 gallons in each of the other baths. The pH in baths 5 through 1 was 10.5, 10.6, 10.7, 10.7, and 1.65, respectively. The condensation water header at the exit to bath 5 was turned on. The pump used to meter solution A into bath 5 was set at 100/80, or at 288 ml/min measured flow. Note the fresh water addition rate into bath 5 was estimated to be about 30 gpm or more. After approximately one hour the pH in each bath was measured with the following results: bath 5 pH=10.0, bath 4 pH=10.2, bath 3 pH=10.4, bath 2 pH=10.4, and bath 1 pH=1.8. The pump used to meter solution A into bath 5 was increased to 100/100, or a measured output of 312 ml/min. Note that problems with water carryover even past the dryer section were observed. This carryover is leaving a light gray slobber pattern. Turning off the condensate header does not seem to affect the water carryover.

Approximately 45 minutes after checking the pH in each bath, the advancement of the steel through the baths was stopped for sixteen minutes. After the sixteen minute stop the steel positioned within baths 5, 4, 3 and 2 were free of any stain, while the steel in bath 1 had some brown stain covering its entire area along with some stain on the bath 2 area just in front of the bath 1 and 2 wringer roll. Note that the spray rinse was shut off after a few minutes into the sixteen minute stop. The fact that the steel positioned within baths 2–5 continued to look good (i.e. no stains) after sitting still without any water being sprayed on them demonstrates that the present invention passivated the surface of the steel very well. Also, it should be noted that the condensate header was in the off position during this time.

Approximately 35 minutes after the sixteen minute stop the pH in each of baths 5–1 was 10.0, 10.0, 10.1, 10.1, and 6.1, respectively. Note the pH in bath 1 is now out of the desired range for good stain prevention. Thereafter, the advancement of the steel through the baths was stopped for 6.5 minutes. The steel positioned within baths 2–5 looked very good (i.e. no stains), and the overall surface of the steel was white rather than the usual medium to light gray thus demonstrating the effectiveness of the present invention. The steel positioned within bath 1 had a light brown stain, possibly due to the fact that it was not in the correct or acceptable pH range for stain prevention. The pH in baths 5, 4, and 1 was 9.9, 9.9, and 3.8, respectively. The chloride content in bath 5 was 24 ppm which is lower than the normal value of the incoming water. This depressed chloride value could have been the result of a recently installed charcoal filter.

The conductivity level in bath 5 was 1210 and 1316 for bath 4. Note that it appears that solution A adds conductivity to the baths.

Note that a pH monitor/pump setup can be utilized in order to keep the pH of bath 1 in the preferred range. This setup would add very small amounts of acid during periods of low acid carryover into bath 1. Since there would still be 4 other baths and a condensate header to remove acid residuals from the steel, no quality problems should occur, and no stain should occur on the steel positioned within bath 1 during the stops.

While the invention has been illustrated and described in detail in the drawings and foregoing description, such illustration and description is to be considered as exemplary and not restrictive in character, it being understood that only the preferred embodiments have been shown and described and that all changes and modifications that come within the spirit of the invention are desired to be protected.

What is claimed is:

1. An effective passivating composition for adding to an aqueous rinse which is applied to a ferrous metal surface after treatment of said ferrous metal surface with an aqueous acid solution, said composition comprising:

a salt of gluconic acid; and a cationic polymer compound which is poly(oxy-1,2-ethanediyl(dimethyliminio)-1,3-propanediyliminocarbonylimino-1,3-propanediyl (dimethyliminio)-1,2-ethanediyl dichloride).

2. The composition of claim 1, further comprising:

a base, said base being present in said composition in an amount sufficient to adjust the pH of said aqueous rinse to a value greater than 7.0 after said composition is added to said aqueous rinse, wherein said salt is present in said composition in a sufficient amount such that after said composition is added to said aqueous rinse said salt is about 0.02% to about 0.3% by weight per liter of said aqueous rinse, and said cationic polymer compound is present in said composition in a sufficient amount such that after said composition is added to said aqueous rinse said cationic polymer compound is about 0.003% to about 0.05% by weight per liter of said aqueous rinse.

3. The composition of claim 2, wherein:

said base is present in said composition in an amount sufficient to adjust the pH of said aqueous rinse to a value between about 10 and about 11.

4. The composition of claim 1, further comprising:

a wetting agent.

5. The composition of claim 1, wherein:

said salt of gluconic acid is sodium gluconate.

6. The composition of claim 5, wherein:

said base is sodium hydroxide.

7. An effective passivating composition for inhibiting stain formation on a ferrous metal surface, comprising:

a base, said base being present in said composition in an amount sufficient to adjust the pH of an aqueous rinse to a value greater than 7.0 after said composition is added to said aqueous rinse;

a gluconate; and

Poly(oxy-1,2-ethanediyl(dimethyliminio)-1,3-propanediyliminocarbonylimino-1,3-propanediyl (dimethyliminio)-1,2-ethanediyl dichloride), said Poly (foxy-1,2-ethanediyl(dimethyliminio)-1,3-propanediyliminocarbonylimino-1,3-propanediyl (dimethyliminio)-1,2-ethanediyl dichloride) being present in said composition in a sufficient amount such that after said composition is added to said aqueous rinse said Poly(oxy-1,2-ethanediyl(dimethyliminio)-1,3-propanediyliminocarbonylimino-1,3-propanediyl (dimethyliminio)-1,2-ethanediyl dichloride) is about 0.003% to about 0.05% by weight per liter of said aqueous rinse.

8. The composition of claim 7, wherein:

said base is sodium hydroxide, and said gluconate is sodium gluconate.

9. The composition of claim 8, wherein:

said sodium gluconate is present in said composition in a sufficient amount such that after said composition is added to said aqueous rinse said sodium gluconate is about 0.02% to about 0.3% by weight per liter of said aqueous rinse.

10. The composition of claim 9, wherein:

said sodium hydroxide is present in said composition in an amount sufficient to adjust the pH of said aqueous rinse to a value between about 10 and about 11.

11. The composition of claim 10, further comprising:

a wetting agent.

12. A composition for treating a ferrous metal surface comprising:

a salt of gluconic acid; and a cationic polymer compound which is poly(oxy-1,2-ethanediyl(dimethyl iminio)-1,3-propanediyliminocarbonylimino-1,3-propanediyl (dimethyliminio)-1,2-ethanediyl dichloride).

13. The composition of claim 12 further comprising a wetting agent.

14. The composition of claim 12 wherein said salt of gluconic acid is sodium gluconate.

* * * * *